US007124735B2

(12) United States Patent
Kobayashi et al.

(10) Patent No.: US 7,124,735 B2
(45) **Date of Patent: *Oct. 24, 2006**

(54) FUEL INJECTION VALVE AND ITS APPARATUS, METHOD FOR MANUFACTURING INTERNAL COMBUSTION ENGINE AND FUEL INJECTION VALVE AND ITS NOZZLE BODY, AND METHOD FOR MANUFACTURING THE SAME

(75) Inventors: Masayuki Kobayashi, Mito (JP); Koji Harada, Hitachinaka (JP); Toru Ishikawa, Kitaibaraki (JP)

(73) Assignee: Hitachi, Ltd., Tokyo (JP)

( * ) Notice: Subject to any disclaimer, the term of this patent is extended or adjusted under 35 U.S.C. 154(b) by 14 days.

This patent is subject to a terminal disclaimer.

(21) Appl. No.: 11/016,749

(22) Filed: Dec. 21, 2004

(65) Prior Publication Data

US 2005/0103899 A1 May 19, 2005

Related U.S. Application Data

(63) Continuation of application No. 10/329,439, filed on Oct. 27, 2002, now Pat. No. 6,845,748.

(30) Foreign Application Priority Data

Dec. 27, 2001 (JP) ..... 2001-395995
Dec. 11, 2002 (JP) ..... 2002-358831

(51) Int. Cl.
*F02M 51/00* (2006.01)
*F02M 61/18* (2006.01)

(52) U.S. Cl. ..... 123/305; 239/533.12; 239/601

(58) Field of Classification Search ..... 123/295, 123/298, 305, 472; 239/533.12, 601, 533.3
See application file for complete search history.

(56) References Cited

U.S. PATENT DOCUMENTS 6,045,063 A * 4/2000 Koike et al. ..... 239/533.12

(Continued)

FOREIGN PATENT DOCUMENTS

DE 4405921 A1 8/1995

(Continued)

OTHER PUBLICATIONS

Copy of European Patent Office Communication dated Jun. 23, 2003.

*Primary Examiner*—Willis R. Wolfe, Jr.
(74) *Attorney, Agent, or Firm*—Crowell & Moring LLP

(57) ABSTRACT

It is an object of the present invention is to provide a fuel injection valve and its apparatus, and an internal combustion engine, a method for manufacturing the fuel injection valve and its nozzle body, and a method for manufacturing the same capable of securing highly accurate and stabilized fuel spraying characteristics. The fuel injection valve comprises a nozzle body, an injection hole provided in the nozzle body, a valve body for opening and closing a fuel passage from the injection hole relative to the nozzle body, and a drive means for driving the valve body, wherein formed is a protrusion having an opening in communication with the downstream side of the injection hole of the nozzle body and which part of the side and an extreme end are opened. The invention resides in a nozzle body and manufacturing it by plastic processing, and an internal combustion engine using the same.

6 Claims, 9 Drawing Sheets

U.S. PATENT DOCUMENTS 6,092,743 A * 7/2000 Shibata et al. ..... 239/533.12
6,345,601 B1 * 2/2002 Miyajima et al. ..... 123/305
6,453,872 B1 * 9/2002 Miyajima et al. ..... 123/298
6,588,399 B1 * 7/2003 Okamoto et al. ..... 123/305
6,675,766 B1 * 1/2004 Miyajima et al. ..... 123/298
6,840,465 B1 * 1/2005 Abe et al. ..... 239/533.12
6,845,748 B1 * 1/2005 Kobayashi et al. ..... 123/305
6,935,578 B1 * 8/2005 Shibata et al. ..... 239/533.12
2001/0022170 A1 9/2001 Okamoto et al. ..... 123/432

FOREIGN PATENT DOCUMENTS

EP 0918157 A1 5/1999
EP 1036933 B1 3/2000
EP 1188920 A2 9/2001
JP 2001-193607 7/2001

* cited by examiner

FUEL INJECTION VALVE AND ITS APPARATUS, METHOD FOR MANUFACTURING INTERNAL COMBUSTION ENGINE AND FUEL INJECTION VALVE AND ITS NOZZLE BODY, AND METHOD FOR MANUFACTURING THE SAME

BACKGROUND OF THE INVENTION

The present invention relates to a new fuel injection valve and its apparatus, and an internal combustion engine, a method for manufacturing the fuel injection valve and its nozzle body, and a method for manufacturing the same, and particularly relates to a fuel injection valve capable of controlling a spry shape of fuel to be injected (the nozzle body is hereinafter referred to as an L step nozzle), its apparatus, an internal combustion engine, a method for manufacturing the same, its nozzle body and a method for manufacturing the same.

The art in which a nozzle shape of a fuel injection valve for injection fuel directly into the cylinder of the internal combustion engine is adjusted to the size and shape of an in-cylinder injection engine and using conditions is known in Japanese Patent Laid-open No. 329036/2002. In this publication, there is described that the shape of a nozzle is prepared by a processing method such as press processing (plastic processing) using a mold material, casting or the like. Further, in that publication, there is shown a construction in which a protrusion having an opening part of which is opened is formed on the injection hole surface side of the fuel injection valve.

According to the aforementioned Publication, there is described processing by way of press processing (plastic processing) using a mold material, but no consideration is taken in connection with a problem of hanging of forging occurring at the edge when press processing takes place or dimensional accuracy. The hanging of forging of a binding wall forming a spray shape and a turning binding wall, or unevenness of dimension resulting therefrom brings forth instability of the shape of fuel spray.

SUMMARY OF THE INVENTION

It is an object of the present invention to provide a fuel injection valve and its apparatus, and an internal combustion engine, a method for manufacturing the fuel injection valve and its nozzle body, and a method for manufacturing the same capable of coping with various fuel spraying characteristics, capable of securing the highly accurate and stabilized fuel spraying characteristics, and which is excellent in productivity.

The present invention provides a fuel injection valve comprising a nozzle body provided with an injection hole therein, a valve body for opening and closing a fuel passage from said injection hole relative to said nozzle body, and a drive means for driving said valve body, characterized by comprising a protrusion having an opening continuous to said injection hole of said nozzle body and having part of a side opened continuous to an extreme end on the downstream side thereof, and a shape round from the extreme end of said opening to the side.

Further, the present invention provides a fuel injection valve characterized by comprising a protrusion having a semicircular-shaped opening continuous to said injection hole of said nozzle body, part of a side opened continuous to an extreme end on the downstream side thereof, binding walls formed on both sides continuous from said opening to a diametrical direction and a turning binding wall forming said opening, an outer surface of said protrusion having a round shape.

Furthermore, the present invention provides a fuel injection valve characterized by the provision of at least one requirement out of requirements that a protrusion having an opening continuous to the injection hole of the nozzle body and having part of the side on the downstream side opened continuous to the extreme end is formed, and the opening is widened more than the size of the injection hole, that a fuel turning element provided internally of the injection surface having the injection hole of the nozzle body is connected to the nozzle body by plastic flowing of a fastening member, that a fuel turning element provided internally of the injection surface having the injection hole of the nozzle body is connected to the nozzle body by plastic flowing of a fastening member, said element has a square-shaped corner which is a circle having a diameter corresponding to the inner peripheral surface of the nozzle body, and the square-shaped side is a recessed portion, and that the injection surface side member is connected to the nozzle body by plastic flowing or welding, and is further characterized, in addition to the above-described requirement, by the provision of the protrusion, whose outer surface has a round shape.

Further, the protrusion according to the present invention is preferably of a shape about ¼ of the sphere in which a semi-sphere is cut in a diametrical direction, and preferably has binding walls formed on both sides continuous from the opening to the diametrical direction and a turning binding wall forming the opening.

It is preferable that the extreme end having the shape about ¼ of the sphere, that the opening is formed crossing approximately the center of the injection hold, and the semi-spherical outer peripheral surface is circular, that the back is formed into a recessed portion corresponding to the protrusion, that the protrusion is formed in the center on the injection surface side having the injection hole of the nozzle body.

The present invention provides a fuel injection apparatus comprising a fuel injection valve for injection fuel into a cylinder directly, a pump for supplying fuel under pressure to said fuel injection valve, and a control unit for controlling injection of fuel caused by said fuel injection valve.

The present invention further provides an internal combustion engine comprising a cylinder, a piston reciprocating within said cylinder, an intake means for introducing air into said cylinder, an exhaust means for exhausting combustion gas from said cylinder, a fuel injection apparatus provided with a fuel injection valve, a fuel supply means for supplying fuel to said fuel injection valve, and an ignition device for igniting a mixture of air introduced into said cylinder by said intake means and fuel injected into said cylinder by said fuel injection valve. An opening formed in the fuel injection valve is arranged on the ignition device side.

The present invention provides a fuel injection valve characterized in that a protrusion having an opening in which part of the side is opened in a semi-circular shape continuous to the extreme end on the downstream side continuous to the injection hole is formed by plastic processing.

Further, the present invention provides a fuel injection valve characterized in that with respect to the semi-sphere of a blank one surface of which is semi-spherical, an opening in which part of the side is opened in a semi-circular shape continuous to the extreme end on the downstream side of the injection hole is formed by pressurizing and molding vertically, and a binding wall continuous to both sides from the opening to the diametrical direction and a turning binding wall forming the opening are formed.

The present invention further provides a nozzle body for a fuel injection valve in which opening and closing of a passage for injecting fuel into a cylinder relative to the nozzle body from an injection hole provided in the nozzle body is carried out by a valve body, characterized in that a protrusion having an opening in which part of the side is opened in a semi-circular shape continuous to the extreme end on the downstream side continuous to the injection hole is formed.

Further, preferably, the protrusion in the nozzle body for the fuel injection valve has binding walls formed on both sides continuous from the opening to the diametrical direction and a turning binding wall forming the opening.

The nozzle body for the fuel injection valve according to the present invention is manufacture by a method similar to the method for manufacturing the fuel injection valve as described above.

That is, in the fuel injection valve according to the present invention, a binding wall for binding such that fuel injected from the injection hole by the turning force has components in a turning direction even after being moved out of the injection hole is provided on a part in a peripheral direction of an outlet of the injection hole opening. In addition, the protrusion having a shape ¼ of the sphere is formed on the injection surface side of the injection valve, and the radial length (a) of the base of the binding wall surface is longer than the radial length (b) of the upper end. Preferably, the outer peripheral surface of the protrusion is of a circular surface.

Further, the present invention provides a manufacturing method for pressuring a material vertically crossing the semi-sphere or the semi-sphere of a blank provided with a protrusion from the center to the radial direction, and forming a center hole to be a turning binding wall to be binding wall surfaces formed vertically on both sides continuous to an opening and a vertical opening while plastic deforming the processed material radially. Preferably, the blank is a bottomed tube.

In the present invention, preferably, a blank which is disk-like and has a spherical recessed portion in a counter convex surface is used, and the semi-spherical or its protrusion is formed by plastic processing for pressurizing and molding the center of a disk-like blank.

The fuel injection valve of the present invention is able to produce spraying which is unlikely to change the shape with respect to the change in pressure in the cylinder. To this end, a mixture is converged on the ignition device side, and fuel particles are made lean in a direction of the piston to produce spraying. At this time, air outside the spraying can be induced into spraying from a portion where the fuel particles are lean. Thus, a pressure difference between the inside and outside of the spraying can be minimized so that the spraying is unlikely to be crushed.

Concretely, in an outlet portion of the injection hole provided in the fuel injection valve to inject fuel, part of the wall surface forming the injection hole is removed whereby binding of a flow of spray is released to thereby form a deflection spray which is rich on the side in which binding is released and lean on the bound side.

In the internal combustion engine of the present invention, the opening of the fuel injection valve is arranged as mentioned above so that a rich spray is formed on the ignition device side and a lean spray is formed on the piston side.

BRIEF DESCRIPTION OF THE DRAWINGS

Other objects and advantages of the invention will become apparent from the following description of embodiments with reference to the accompanying drawings in which.

DETAILED DESCRIPTION OF THE PREFERRED EMBODIMENTS

Figure 1:
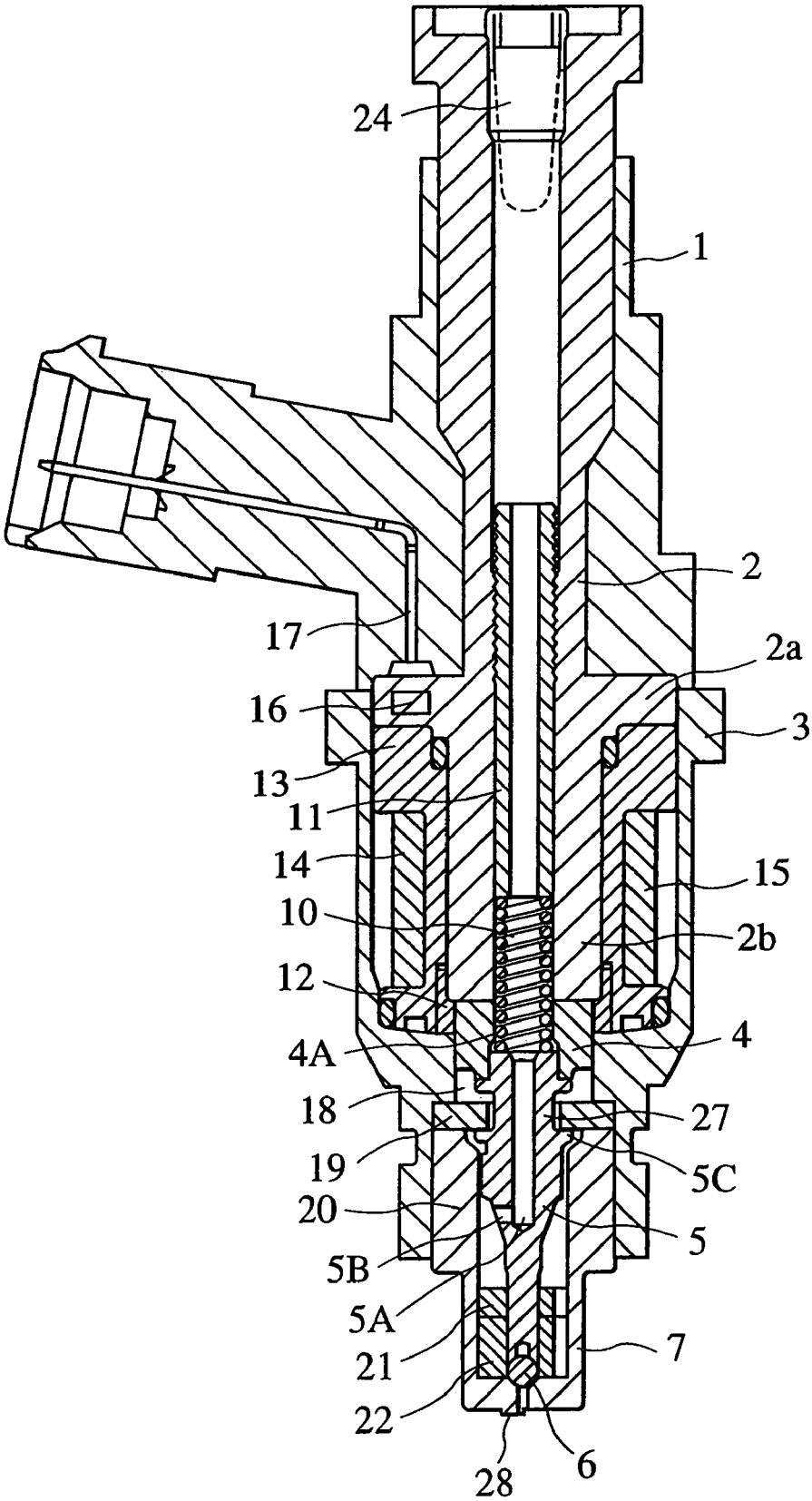
FIG. 1 is a longitudinal sectional view of a fuel injection valve according to the present invention.

FIG. 1 is a sectional view of a fuel injection valve of the present invention. A fuel injection valve 1 injects fuel by opening and closing thereof caused by vertical movement of a ball 6 with respect to a seat portion of a nozzle body 7 described later by an ON-OFF signal of the duty arithmetically calculated by a control unit not shown.

In the following explanation, a surface parallel to a valve fuel injection valve axis, including a fuel injection valve axis (valve fuel injection valve shaft center), is called a longitudinal section, and a plane perpendicular to a valve fuel injection valve axis is called a cross section.

A magnetic circuit comprises a yoke 3, a core 2 comprising a plug portion 2*a* for closing an upper opened end of the yoke 3 and a columnar portion 2*b* extending to the center of the yoke 3, and an anchor 4 facing to the core 2 through a gap. The columnar portion 2 is provided in its center with a hole 4A for holding a coil spring 10 which acts to press, toward a seat surface 9, a valve body 27 comprising the anchor 4 formed of a magnetic material and a rod 5, and the ball 6 joined to the rod 5. The seat surface 9 is formed conically on the nozzle body 7 so as to be positioned on the upstream side of an injection hole 8 along with the injection hole 8. The upper end of the spring 10 comes in contact with the lower end of a spring adjuster 11 inserted into the center of the core 2 to adjust a set load. In a clearance facing to the side of the columnar portion 2*b* of the core 2 and the side of the valve body 2 of the yoke 3 is provided a seal ring 12 secured mechanically therebetween in order to prevent fuel from flowing out to the side of a coil 14.

The coil 14 for exciting a magnetic circuit is wound about a bobbin 13, the outer circumference of which is molded by a plastic material to form a coil assembly 15. A terminal 17 of the coil assembly 15 is inserted into a hole 16 provided in a plug body (collar) 2*a* of the core 2, and the terminal 17 is joined to a terminal of a control unit not shown. The yoke 3 is bored with a plunger-receiving portion 18 for receiving a valve body 27, and a nozzle-receiving portion 20 which is larger in diameter than the plunger-receiving portion 18 and for receiving a stopper 19 and a protrusion 7 is provided extending through the extreme end of the yoke 3.

A cavity 5A for allowing passage of fuel is bored on the side of the anchor 4 of the rod 5. This cavity 5A is provided with an outflow port 5B for fuel. The valve body 27 guides, when the outer circumference of the anchor 4 comes in contact with the inner circumference of the seal ring 12, the axial movement thereof, and the ball 6 or the neighbor of an end on the side of the ball 6 of the rod 5 is guided by an inner peripheral surface 23 of a fuel turning element 22.

The fuel turning element 22 is inserted into a hollow portion defined by the protrusion 7, and comes in contact with an inner wall 21 on the upstream side of the seat surface 9 and is positioned. Further, the stroke of the valve body 27 (in FIG. 1, an amount of moving upwardly of the shaft) is set by a dimension between a receiving surface 5C of a neck of the rod 5 and the stopper 19. A filter 24 is provided to prevent dust or foreign matter in piping from moving into fuel or toward the valve seat side between the ball 6 and the seal surface 9.

The operation of the fuel injection valve 1 in the present embodiment will be explained. When an electric signal is transmitted to the coil 14, a magnetic circuit is formed by the core 2, the yoke 3, and the anchor 4, and the anchor 4 is attracted on the side of the core 2. When the anchor 4 is moved, the ball 6 is moved away from the seat surface 9, and the fuel passage is opened. Fuel flows into the fuel injection valve 1 from the filter 24, then flows to the downstream through the outflow 5B of fuel from the internal passage of the core 2, the outer peripheral portion of the anchor 4 and the cavity 5A for allowing passage of fuel provided within the anchor 4, and is supplied, while turning, to the seat portion passing through a longitudinal fuel passage 25 and a diametrical fuel passage 26.

Figure 2A:
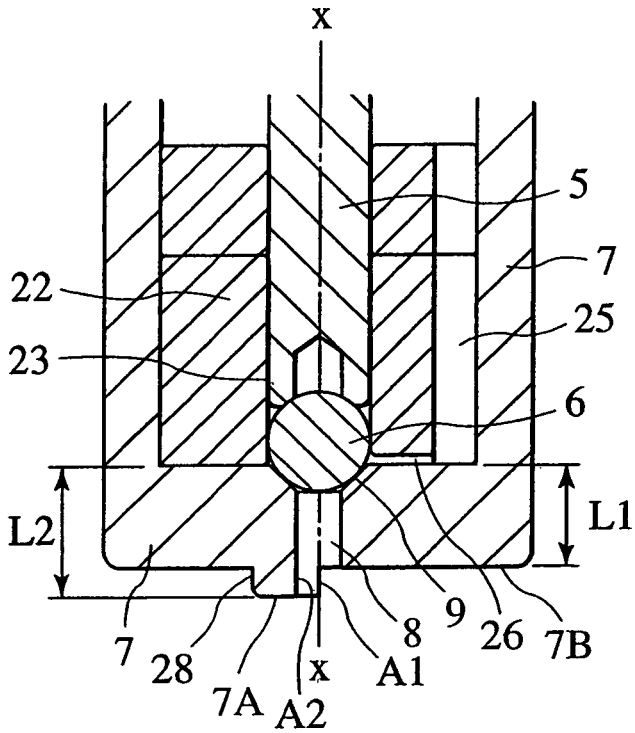
FIG. 2A is an enlarged sectional view of the nozzle-integral type distal end of the fuel injection valve of FIG. 1.
Figure 2B:
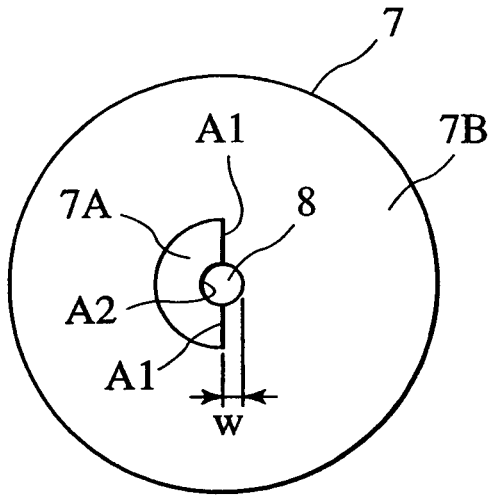
FIG. 2B is a bottom view of the nozzle-integral type distal end of FIG. 2A.
Figure 2C:
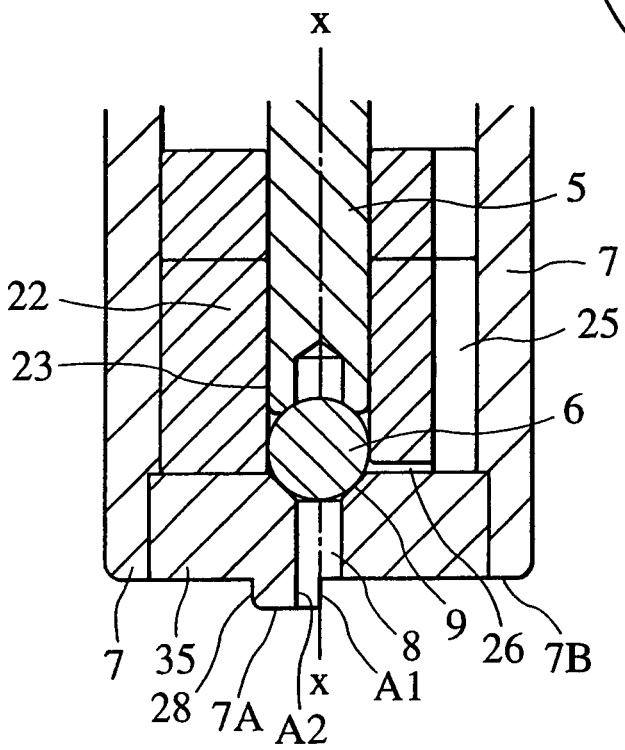
FIG. 2C is an enlarged sectional view of the distal end of another fuel injection valve.
Figure 3:
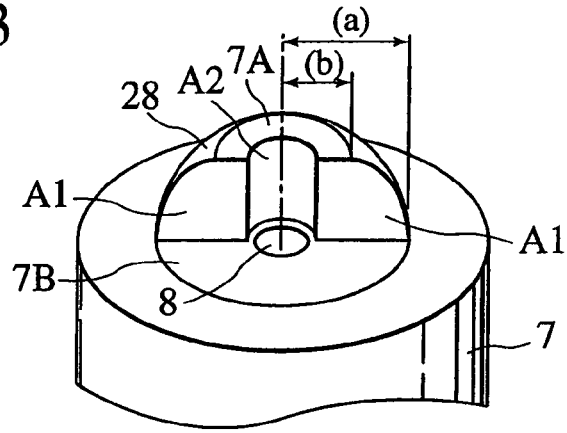
FIG. 3 is a perspective view of a portion of an injection hole portion of a nozzle body for a fuel injection valve according to the present invention.

FIG. 2A is an enlarged sectional view of the extreme end of a nozzle body integrated type of the fuel injection valve shown in FIG. 1, FIG. 1B is a plan view of the lower surface of FIG. 1A, FIG. 1C is an enlarged sectional view of the extreme end showing a further example of the fuel injection valve, and FIG. 3 is a partial perspective view of a nozzle body extreme end for the fuel injection valve in the present embodiment. The nozzle body having a binding wall in the present embodiment will be explained hereinafter with reference to FIGS. 2 and 3. FIG. 2A shows a method for forming the nozzle body 7 by cutting a rod material or for integrally forming it by plastic processing by way of cold forging, either of which may be employed. In the injection hole 8, its center is registered with the axis x—x of the fuel injection valve (shaft center of the fuel injection valve), and the step wall surface is formed parallel with the axis x—x. A step upper surface 7A formed with an outlet opening of the injection hole 8 is formed with a binding wall constituted by a step bottom surface 7B perpendicular to the axis x—x, a step wall surface A1 approximately parallel with the axis x—x, and a turning binding wall A2. In this case, the width of the injection hole of the binding wall, the length of the injection hole at a portion most deeply notched thereof, and a portion not notched (the least) are represented by W, L1, and L2, respectively, and the extreme end surface of the nozzle body 7 is formed by two planes 7A, 7B vertical to the axis x—x formed so as to put the injection hole 8 therebetween, and planes A1, A2 parallel with the axis x—x which connect these planes 7A, 7B.

FIG. 2C shows the so-called orifice plate type. There may be employed either method in which a disk-like member 35 of the present invention having a protrusion at the extreme end of the injection hole 8 of the nozzle body 7 is provided separately, and the disk-like member 35 is connected to the nozzle body 7 by plastic flowing a joint portion of both parts in the outer circumference of the disk-like member 35 by ring-like punching; or method for irradiating a laser beam against the laminated portion to effect welding. The diameter of the disk-like member 35 is made to be slightly larger than that of the nozzle body 7 so that they are positioned and fitted to each other. Alternatively, the disk-like member 35 is not fitted into the nozzle body 7 but the former is set to the end of the nozzle body 7, and they are welded together on the sides with a laser beam.

Further, as shown in a perspective view of FIG. 3, a protrusion 28 comprises a protrusion having a shape of about ¼ of the sphere, upper end of which is flat and the radial length (b) is small with respect to the radial length (a) of a base of the binding wall surface. According to this constitution, an outlet open surface of the injection hole 8 is formed having a difference in level on the planes 7A, 7B having a difference in level. The height of the protrusion 28 may be spherical with respect to the sphere, and set to a suitable height not more than the radius while adjusting to the injection conditions, but in the present embodiment, the height is set to 0.2 mm. The outer circumferential surface of the protrusion 28 is a circular surface. Accordingly, there are a part of the side with respect to the injection surface of the injection hole 8, the turning binding wall A2 for forming an opening formed vertically having the extreme end opened continuous to the aforesaid part, and the binding walls A1 formed vertically on both sides continuous thereto. The binding wall A1 is preferably the center of the injection hole 8 in the semispherical protrusion 28. The opening of the turning binding wall A2 is formed prior to forming the injection hole 8, and since the injection hole 8 is formed later, a clearance having a diameter somewhat larger than that of the former is provided, which is likewise provided vertically.

The diameter of the protrusion 28 is preferably approximately three times the height thereof, and the extreme end is flatten whereby the accurate height can be set.

Thus, the fuel injection valve according to the present invention can be said to have the following constitution.

(1) Two intersections of a section parallel to the center shaft including the center shaft of the injection hole 8 and the edge forming the outlet opening of the injection hole 8 are deviated in the direction along the center axis, and the difference in level is formed on the edge forming the outlet opening in the midst from one intersection to the other.

(2) In this case, the two edges forming the outlet opening between the two intersections and the difference in level portion are parallel with each other as viewed from the direction vertical to the above-described section.

(3) Further, the edge forming the outlet opening is formed so as to be changed in the direction along the center axis at the difference in level portion.

(4) The outlet opening surface of the injection hole 8 is formed so as to have the difference in level in the direction of the center axis of the injection hole 8.

(5) A difference in level is provided in the outlet opening of the injection hole 8 so that the length of the passage wall forming he injection hole 8 changes having a portion which changes in the non-linear form in the peripheral direction of the injection hole 8.

(6) The outlet opening of the injection hole 8 is formed with the notch approximately parallel with the center shaft of the injection hole, and the wall surface on one side is removed from the notch to thereby form the difference in level.

(7) The difference in level is formed on the nozzle extreme end surface formed with the outlet opening of the injection hole 8 whereby the difference in level is formed on the outlet opening surface.

(8) The difference in level in the direction of the center axis of the injection hole 8 is formed on the edge forming the outlet opening of the injection hole 8 so that the length of the passage wall surface forming the injection hole 8 changes in the peripheral direction of the injection hole 8, and at the fuel inlet to the fuel injection valve, a pressure of 1.0 to 20 MPa is applied to fuel for injection.

Next, the method for manufacturing the nozzle body 7 according to the present embodiment will be explained with reference to FIG. 4.

Figure 4A:
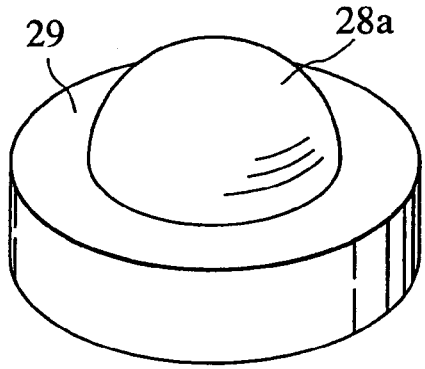
FIGS. 4A, 4B and 4C are views of the cold forging steps for an injection hole portion of a nozzle body for the fuel injection valve according to the present invention.
Figure 4B:
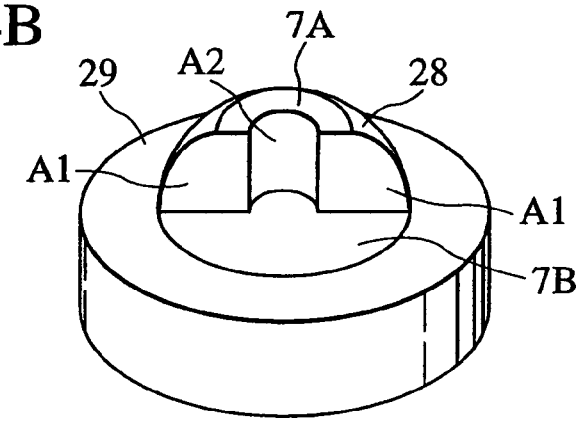
Figure 4C:
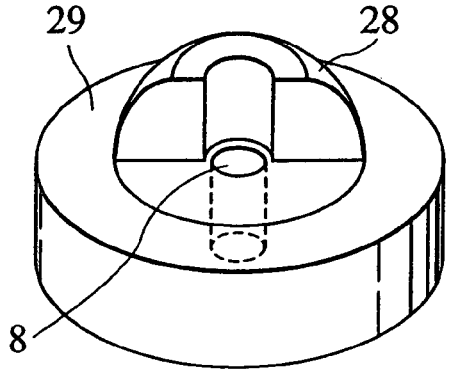

FIGS. 4A to 4C show the shapes of the nozzle body 7 in processes from a blank 29 to the boring of an injection hole, and the blank 29 of the nozzle body is martensitic stainless steel, which is SUS 420 J2 in consideration of plastic processing property.

The blank 29 provided with a semispherical convex portion 28*a* as shown in FIG. 4A is first, in the first step, pressurized in a vertical direction crossing half of the semispherical convex portion in a radial direction from the center by a mold having a final shape to have a shape of ¼ of the sphere as shown in FIG. 4B. Then the step upper surface 7A, the step bottom surface 7B, the step wall surface A1 and the turning binding wall A2 are simultaneously pressurized and molded while radially plastic deforming the pressurized material. The projection of the shape of a blank semicircle ball is below the half of a ball. Where the semispherical convex portion is pressurized, since the volume of material processed is less than that where a columnar convex portion is pressurized, hanging of the step upper surface can be suppressed. Subsequently, the injection hole 8 is bored by punching as shown in FIG. 4C. Accordingly, in FIG. 4B, a clearance is provided so that the diameter of the opening is larger than the injection hole 9 in terms of the manufacture in the processing. Preferably, the radius of the clearance is 20 to 50 μm.

Further, as shown in FIG. 4B, in the shape of ¼ of the sphere, its extreme end is processed to be flat whereby the height can be formed in the stabilized manner, processing can be made with high accuracy, and the stabilized injection can be formed. The height of the protrusion 28 is 0.1 to 0.5 mm, preferably, 0.15 to 0.3 mm. Preferably, an opening angle of the binding wall A1 is 180 to 90 degrees.

Figure 5A:
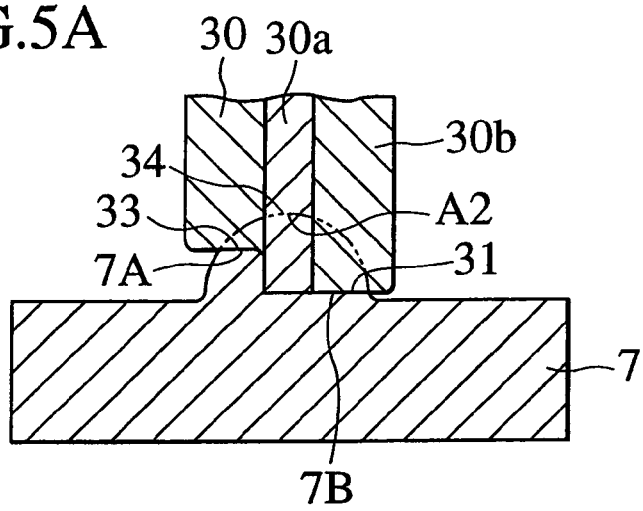
FIG. 5A is a sectional view showing part of a manufacturing step for an injection hole portion of a nozzle body for a fuel injection valve according to the present invention.
Figure 5B:
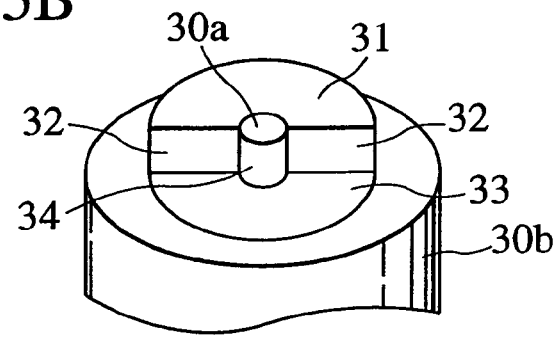
FIG. 5B is a partial perspective view showing a plastic processing means (punch) used for the manufacturing step.
Figure 6A:
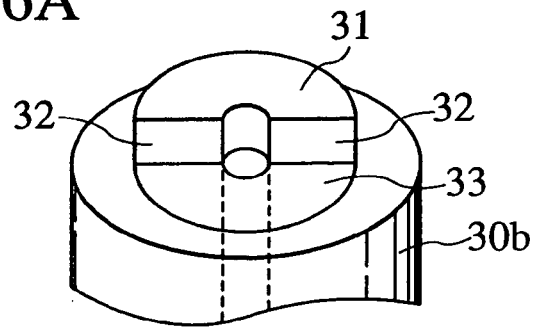
FIG. 6A is a partial perspective view showing an exploded state of the punch shown in FIGS. 5A and 5B.
Figure 6B:
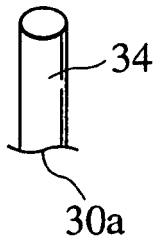
FIG. 6B is a partial perspective view showing an exploded state of the rod-like punch shown in FIG. 5A an 5B.

FIG. 5A shows the state that the first plastic processing step (cold forging step) of FIG. 4B is being carried out. A punch 30 is step-like in section, and a rod-like punch 30*a* as shown in FIG. 6A is incorporated into and integrated with a punch 30*b* as shown in FIG. 6A, and the extreme end surface of the punch 30*b* and the extreme end surface of the punch 30*a* are made in the same plane as in FIGS. 5A and 5B.

The punch 30*b* is formed with a transfer surface 31 for forming the step bottom surface 7B, a transfer surface 32 for forming the step wall surface A1, and a transfer surface 32 for forming the step upper surface 7A. Further, the rod-like punch 30*a* is formed with a transfer surface 34 for forming the turning-binding wall A2. The portion indicated by a dash-dotted contour line in FIG. 5 shows a portion where the convex portion prior to molding has been present.

Figure 7A:
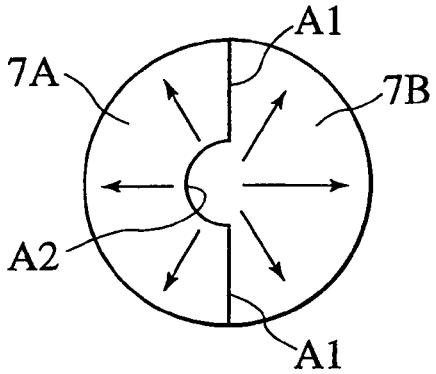
FIG. 7A is a diagram illustrating the plastic flowing at the time of the injection hole manufacturing step of a nozzle body according to the present invention.
Figure 7B:
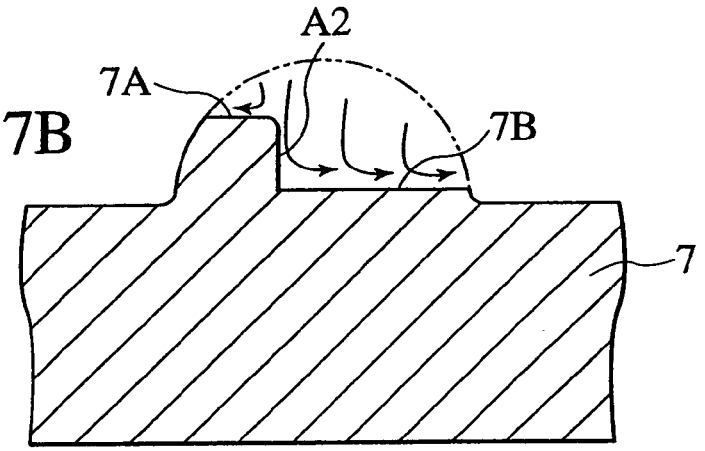
FIG. 7B is a longitudinal sectional view illustrating the plastic flowing of FIG. 7A.

FIG. 7 shows a plastic flowing of metal when the convex portion is subjected to pressurizing molding. The plastic flowing is carried out under the constant pressurizing force and pressurizing speed by a mold. That is, where the semispherical convex portion of the blank is pressurized, the step wall surface A1 and the turning binding wall A2 are formed even if the step upper surface 7A is not pressurized by the transfer surface 33. However, there is a disadvantage that a difference occurs in wall height due to the unevenness of processing of the spherical convex portion. Accordingly, the step upper surface 7A is pressurized by the transfer surface 33 to mold the step upper surface 7A, and even where unevenness of processing should occur in the spherical convex portion, the wall height is the same as the height of the mold, because of which the wall height can be molded in the stabilized manner.

Thereafter, the nozzle blank 29 is subjected to injection hole molding processing for the injection hole 8 in the direction of the injection hole outlet to form the nozzle body 7 via heat treatment or the like. Accordingly, the semispherical convex portion is pressurized whereby a highly accurate nozzle which is less in hanging of forging, and free from burrs can be manufactured, and the stabilized spray characteristic can be obtained.

Figure 8A:
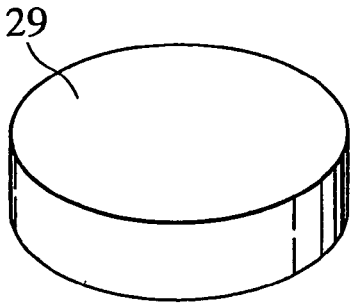
FIG. 8A is a perspective view showing a blank in part of the injection hole manufacturing step of a nozzle body according to the present invention.
Figure 8B:
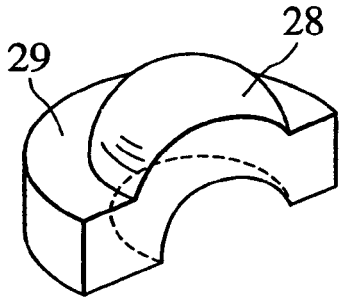
FIG. 8B is a perspective view showing the blank having a semispherical convex portion in part of the infection hole manufacturing step of a nozzle body according to the present invention.

While in the embodiment as described above, the blank provided with the semispherical protrusion is subjected to cutting, a method is not limited thereto but for example, as shown in FIG. 8A, one surface of a disk-like blank is pressurized by a spherical mold to form a recessed surface in advance, whereby a semispherical convex portion may be plastic forged on one surface by cold forging as shown in FIG. 8B. When the recessed surface is formed to be spherical, the plastic flowing is smooth, and the convex portion can be molded with high accuracy.

Further, in the present embodiment, although not shown, since fuel is injected directly into a cylinder by the fuel injection valve 1, there is provided a fuel injection apparatus comprising a pump for pressurizing and supplying fuel to the fuel injection valve 1 and a control unit for controlling injection of fuel by means of the fuel injection valve 1.

Figure 9A:
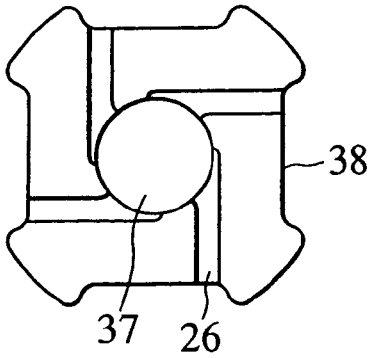
FIG. 9A is a plan view of a fuel turning element according to the present invention.
Figure 9B:
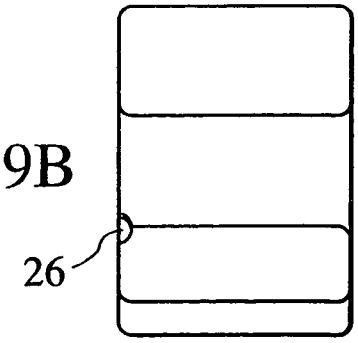
FIG. 9B is a side view of the fuel turning element of FIG. 9A.
Figure 10A:
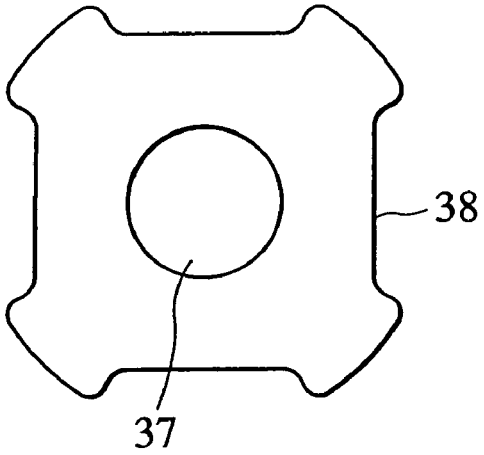
FIG. 10A is a plan view of a fastening member according to the present invention.
Figure 10B:
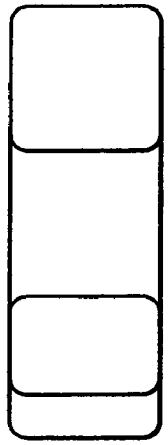
FIG. 10B is a side view of the fastening member of FIG. 10A.

FIGS. 9A and 9B are respectively a plan view and a side view of the fuel turning element 22 used for the extreme end of the fuel injection valve, and FIGS. 10A and 10B are likewise respectively a plan view and a side view of the fastening member 21 used for the extreme end of the fuel injection valve. As shown in the figures, these members have a diameter in which each corner portion of a square shape is registered with the diameter of the inner peripheral surface of the nozzle body 7, and each side is made to have a recessed portion 38, each corner being round, and the side is made to have the recessed portion 38 whereby supplying of fuel can be facilitated. The fuel turning element 22 is provided with four rod insert holes 37 corresponding to the insert holes of the rod 5 and fuel turning grooves 26 continuous to the rod insert holes 37 vertically to each side.

In connection of these to the nozzle body 7, the outer circumference of each corner of the fastening member 21 is locally pressed into a ring-like shape by a punch and subjected to plastic flowing and caulked. The fuel turning element 22 is fixed by caulking the fastening member 21. Further, the fuel turning element 22 alone will also suffice, and this fixing is similar to that of the fastening member 21. As described, the fixing is facilitated by caulking of only the circumference of each corner.

Figure 11:
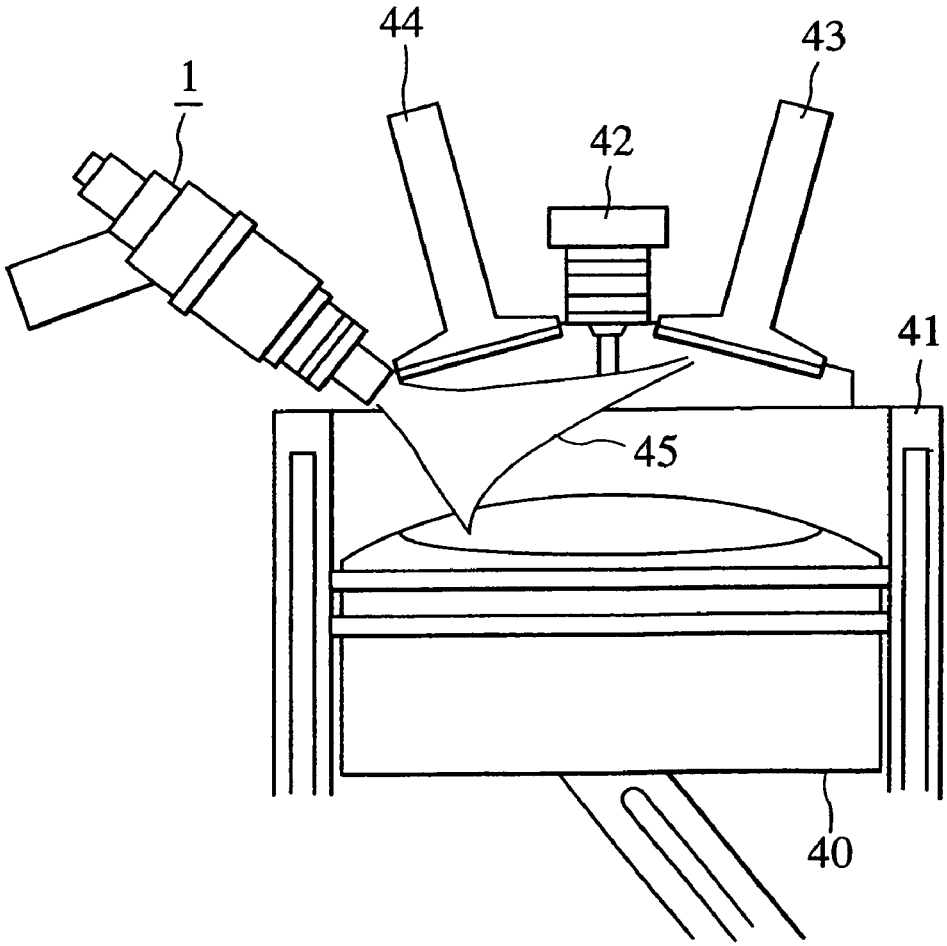
FIG. 11 is a sectional view of the neighbor of a piston using a fuel injection valve according to the present invention for an internal combustion engine.

FIG. 11 is a sectional view of the neighbor of a piston using the aforementioned fuel injection valve in the internal combustion engine. As shown in FIG. 11, the internal combustion engine according to the present embodiment comprises, a piston 40 which reciprocates within a cylinder 41, an intake means having an intake valve 43 for introducing air into the cylinder 41, an exhaust means having an exhaust valve 44 for exhausting combustion gas from the cylinder 41, a fuel injection apparatus provided with the fuel injection valve 1, a fuel supply means for supplying fuel to the fuel injection valve 1, and an ignition device 42 for igniting a mixture of air introduced into the cylinder 41 by the intake means and fuel injected into the cylinder 41 by the fuel injection valve 1. The fuel injection valve 1 comprises, as mentioned above, the injection hole 8 provided in the nozzle body 7, the valve body for opening and closing the fuel passage by the injection hole 8 relative to the nozzle body 7, and a drive means for driving the valve body 27. The nozzle body 7 has an opening having part of the side opened along the downstream side of the injection hole 8 on the injection surface side having the injection hole 8 on the injection surface side of the injection hole 8, and is arranged so that the opening is disposed on the ignition device side.

As described above, in the fuel injection valve 1, the opening having a specific construction is arranged toward the ignition device to thereby form a fuel injection region 45 deviated on the ignition device side as shown in FIG. 9. Thus, the ignition property of the internal combustion engine can be improved, and the discharge quantity of non-burned gas components of a combustion gas can be reduced.

Another embodiment will be described below. The explanation of the same parts described heretofore is omitted, and only different parts will be described, like numerals and characters being used to refer to like and corresponding parts of the drawings in this embodiment as long as there is no specific explanation.

Figure 12A:
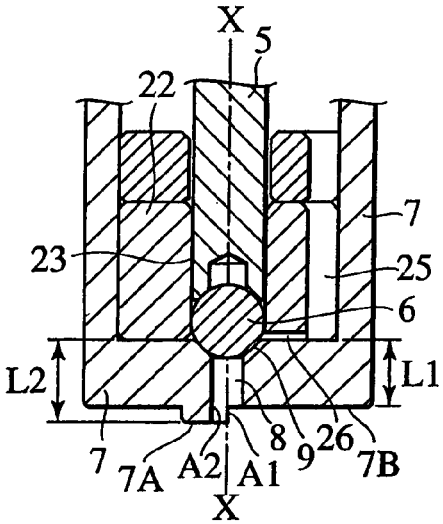
FIG. 12A is an enlarged sectional view of the distal end of the fuel injection valve shown in FIG. 1.
Figure 12B:
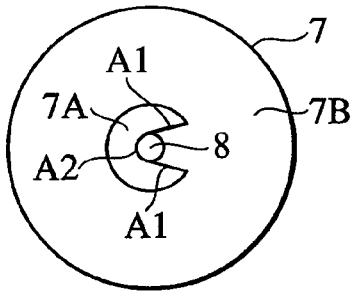
FIG. 12B is a bottom view of the distal end shown in FIG. 12A.
Figure 13:
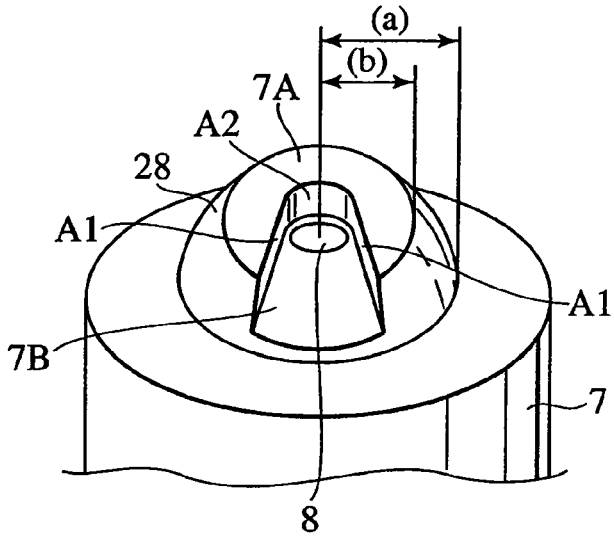
FIG. 13 is a partial perspective view of the distal end of a nozzle body for the fuel injection valve.

FIG. 12A is an enlarged view of the distal end of the fuel injection valve shown in FIG. 1. FIG. 12B is a bottom view of the distal end of the fuel injection valve. FIG. 13 is a partial perspective view of the tip of a nozzle body for the fuel injection valve of the present embodiment. A nozzle body 7 having a binding wall according to the present embodiment will be described below with reference to FIGS. 12A, 12B and 13. An injection hole 8 is disposed coaxially with the axis x—x of the fuel injection nozzle, namely, the fuel injection nozzle center axis. A turning binding wall A2 is formed substantially parallel to the axis x—x. A nozzle upper surface 7A and the turning binding wall A2 are provided on the nozzle bottom surface 7B perpendicular to the axis x—x along which the injection hole 8 is bored. The turning binding wall A2 serves to direct a jet for circumferential radiation. Binding walls A1 opening in the shape of a sector are formed along the respective radial extensions of the turning binding wall. The opening angle formed by the binding walls A1 is set within 90°, preferably, at 30°. As for the length of the injection hole, if a thickness L1 up to the nozzle bottom surface is 1.8 mm, a thickness L2 up to the nozzle upper surface is 2.0 mm. A nozzle portion 28 is generally in the shape of a truncated cone, and its surface is formed spherically. To be more specific, the radius (b) of the nozzle upper surface 7A is smaller than the radius (a) of the base of the turning binding wall, both the radii (b) and (a) centering on the center of the injection hole. Although the diameter of the turning binding wall A2 may be equal to that of the injection hole 8 in view of a jet function, the diameter of the turning binding wall A2 is larger than that of the injection hole 8 taking press working into consideration.

A method of manufacturing the nozzle body 7 according to the present embodiment will be described with reference to FIGS. 14A, 14B and 14C, which show the shapes of the nozzle body 7 in processes from a blank 29 to the boring of an injection hole, and the blank 29 of the nozzle body 7 is martensitic stainless steel, which is SUS 420 J2 taking plastic processing property into consideration.

Figure 14A:
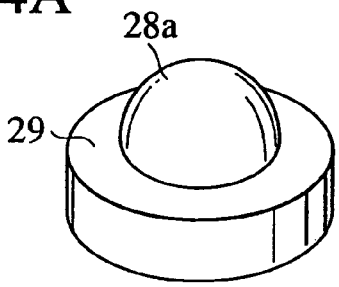
FIGS. 14A, 14B and 14C are views showing the shapes of the nozzle body in processes from a blank to the boring of an injection hole.
Figure 14B:
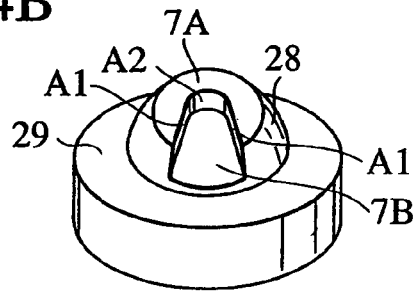
Figure 14C:
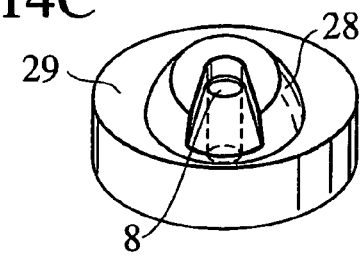

The blank 29 provided with a semispherical convex portion 28*a* as shown in FIG. 14A is first, in the first step, pressurized in a vertical direction crossing half of the semispherical convex portion in a radial direction from the center by a mold having a final shape as shown in FIG. 14B. Then the nozzle upper surface 7A, the nozzle bottom surface 7B, the binding wall A1 and the turning binding wall A2 are simultaneously pressurized and molded while radially plastic deforming the pressurized material. In addition, since nozzle upper surface 7A and nozzle bottom 7B fabricate with a punch, a surface of a sphere 28 changes into the crushed form. In FIG. 14B and FIG. 14C, modification of a surface of a sphere 28 is omitted and indicated. Where the semispherical convex portion is pressurized, since the volume of material processed is less than that where a columnar convex portion is pressurized, hanging of the nozzle upper surface can be suppressed.

Figure 15A:
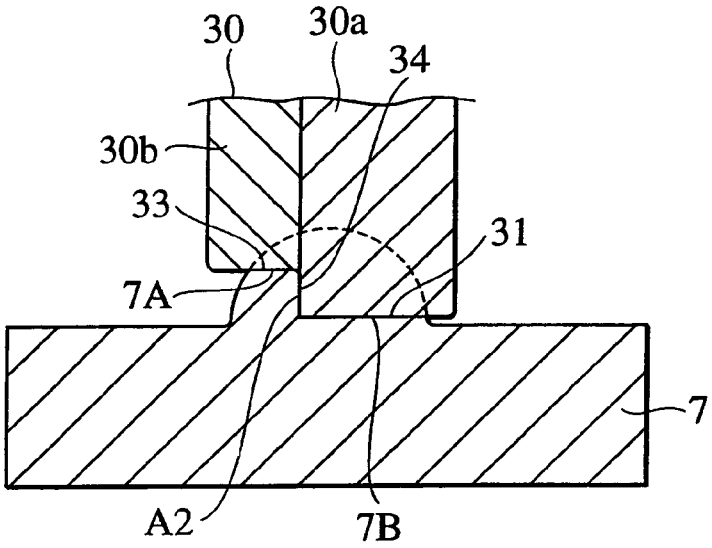
FIG. 15A is a sectional view showing a cold forging process by the use of punches.
Figure 15B:
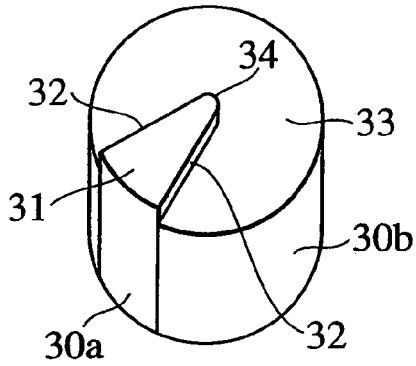
FIG. 15B is a partial perspective view of the punches shown in FIG. 15A.
Figure 16A:
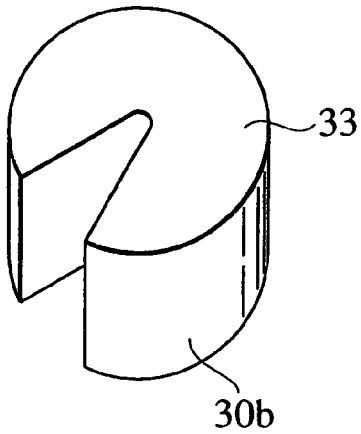
FIG. 16A is a perspective view of one of the punches of FIG. 15B.
Figure 16B:
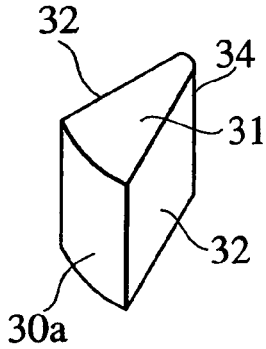
FIG. 16B is a perspective view of the other punch.

FIG. 15A shows the state that the first plastic processing step (cold forging step) of FIG. 14B is being carried out. A punch 30 is step-like in section, and a punch 30*a* as shown in FIG. 16B is incorporated into and integrated with a punch 30*b* as shown in FIG. 16A, and the extreme end surface of the punch 30*b* and the extreme end surface of the punch 30*a* are made in a step manner as in FIGS. 15A and 15B.

The punch 30*a* is formed with a transfer surface 31 for forming the nozzle bottom surface 7B, and a transfer surface 32 for forming the nozzle wall surface A1. Further, the punch 30*b* is formed with a transfer surface 33 for forming the nozzle upper surface 7A, and the punch 30*a* is formed with a transfer surface 34 for forming the turning-binding wall A2. The portion indicated by a dash-dotted contour line in FIG. 15 shows a portion where the convex portion prior to molding has been present.

Figure 17A:
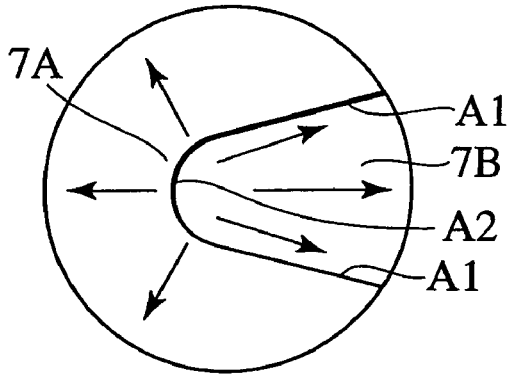
FIG. 17A is a diagram illustrating the plastic flowing at the time of the injection hole manufacturing step of a nozzle body according to the present invention.
Figure 17B:
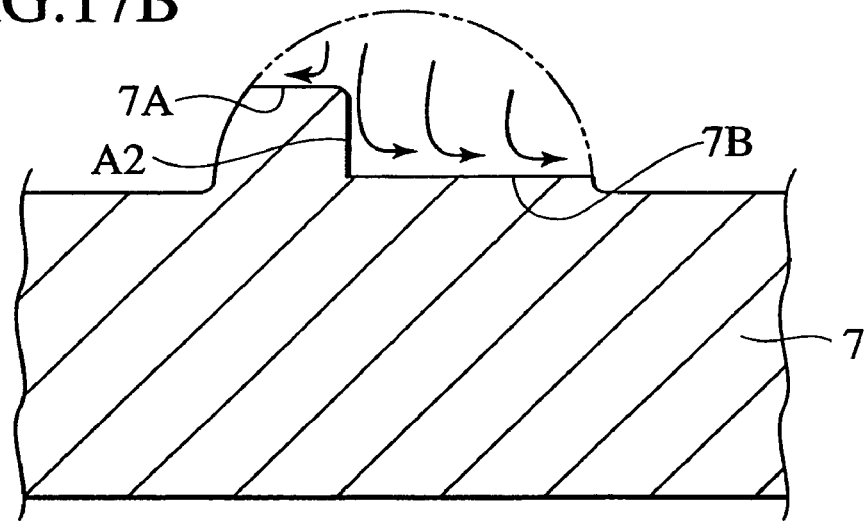
FIG. 17B is a longitudinal sectional view illustrating the plastic flowing of FIG. 17A.

FIG. 17 shows a plastic flowing of metal when the convex portion is subjected to pressurizing molding. The plastic flowing is carried out under the constant pressurizing force and at the constant pressurizing speed by a mold. That is, where the semispherical convex portion of the blank is pressurized, the nozzle wall surface A1 and the turning binding wall A2 are formed even if the nozzle upper surface 7A is not pressurized by the transfer surface 33. However, there is a disadvantage that a difference occurs in wall height due to the unevenness of processing of the spherical convex portion. Accordingly, the nozzle upper surface 7A is pressurized by the transfer surface 33 to mold the nozzle upper surface 7A, and even where unevenness of processing should occur in the spherical convex portion, the wall height is the same as the height of the mold, because of which the wall height can be provided in the stabilized manner.

Thereafter, the nozzle blank 29 is subjected to injection hole molding processing for the injection hole 8 in the direction of the injection hole outlet to form the nozzle body 7 via heat treatment or the like. Accordingly, the semispherical convex portion is pressurized whereby a highly accurate nozzle which is less in hanging of forging, and free from burrs can be manufactured, and the stabilized spray characteristic can be obtained.

Figure 18A:
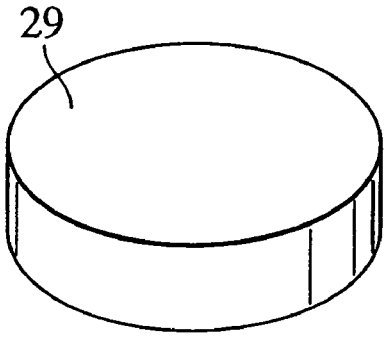
FIG. 18A is a perspective view showing a blank in part of another injection hole manufacturing step of a nozzle body according to the present invention.
Figure 18B:
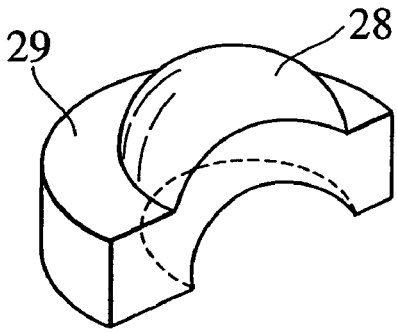
FIG. 18B a perspective view showing the blank having a semispherical convex portion in part of the injection hole manufacturing step of a nozzle body according to the present invention.

While in the embodiment as described above, the blank provided with the semispherical protrusion is subjected to cutting, a method to be adopted is not limited thereto. For example, as shown in FIG. 18A, one surface of a disk-like blank is pressurized by a spherical mold to form a recessed surface in advance, whereby a semispherical convex portion may be plastic forged on one surface by cold forging as shown in FIG. 18B. When the recessed surface is formed to be spherical, the plastic flowing is smooth, and thereby the convex portion can be molded with high accuracy.

Further, in the present embodiment, there is provided a fuel injection apparatus, not shown, comprising a fuel injection valve 1 for directly injecting fuel into a cylinder, a pump for supplying fuel under pressure to the fuel injection valve 1 and a control unit for controlling injection of fuel by means of the fuel injection valve 1.

Thus, the following constitution is provided. A fuel injection valve comprising a nozzle body, a fuel injection hole extending through the nozzle body in the axial direction, a nozzle portion formed projectingly around the fuel projecting hole to direct injected fuel, a valve body for opening and closing a fuel passage to the fuel injection hole, and driving means for driving the valve body, is characterized in that the nozzle portion is provided with a turning binding wall formed around the axis of the injection hole, and a binding wall continuous to the turning binding wall, the outer circumference of the nozzle portion being semispherical.

Further, according to the embodiments described above, the following constitution can be provided.

A fuel injection valve comprising a nozzle body provided with an injection hole therein, a valve body for opening and closing a fuel passage from the injection hole relative to the nozzle body, and a drive means for driving the valve body, is characterized by forming a protrusion having an opening continuous to the injection hole of the nozzle body and having part of a side opened continuous to an extreme end on the downstream side thereof, and the opening being widened more than the size of the injection hole.

A fuel injection valve comprising a nozzle body provided with an injection hole therein, a valve body for opening and closing a fuel passage from the injection hole relative to the nozzle body, and a drive means for driving said valve body, is characterized in that a fuel turning element provided internally of the injection surface having the injection hole of the nozzle body is connected to the nozzle body by plastic flowing of a fastening member, and in the fuel turning element, a square-shaped corner is a circle having a diameter corresponding to the inner peripheral surface of the nozzle body, and the square-shaped side is in the form of a recessed portion.

A fuel injection valve comprising a nozzle body, an injection surface side member boring an injection hole provided in the nozzle body, a valve body for opening and closing a fuel passage from the injection hole relative to the nozzle body, and a drive means for driving the valve body, is characterized in that the injection surface side member is connected to the nozzle body by plastic flowing or welding.

An internal combustion engine comprising a cylinder, a piston reciprocated within the cylinder, an intake means for introducing air into the cylinder, an exhaust means for exhausting combustion gas from the cylinder, a fuel injection device provided with a fuel injection valve, a fuel supply means for supplying fuel to the fuel injection valve, and an ignition device for igniting a mixture of air introduced into the cylinder by the intake means and fuel injected into the cylinder by the fuel injection valve, is characterized in that said fuel injection valve comprises a nozzle body, an ignition hole provided in the nozzle body, a valve body for opening and closing a fuel passage from the injection hole relative to the nozzle body, and a drive means for driving the valve body, the nozzle body having an opening opened in a semi-circular shape with part of the side continuous to the extreme end on the downstream side continuous to the injection hole, the opening being arranged so as to be the side of the ignition device.

A method for manufacturing a fuel injection valve comprising a nozzle body, an injection hole provided in said nozzle body, a valve body for opening and closing a fuel passage from the injection hole relative to the nozzle body, and a drive means for driving the valve body, is characterized in that a protrusion having an opening opened in a semi-circular shape with part of the side continuous to the extreme end on the downstream side continuous to the injection hole of the nozzle body is formed by plastic processing.

A nozzle body for a fuel injection valve in which opening and closing of a passage for injection fuel into a cylinder relative to said nozzle body from an injection hole provided in the nozzle body is carried out by a valve body, is characterized in that a protrusion having an opening opened in a semi-circular shape with part of the side continuous to the extreme end on the downstream side continuous to the injection hole of the nozzle body is formed, and the outer extreme end of the protrusion is round.

A nozzle body for a fuel injection valve in which opening and closing of a passage for injecting fuel into a cylinder relative to an injection hole and relative to a nozzle body from the injection hole provided in the nozzle body is carried out by a valve body, is characterized in that a protrusion having an opening opened with part of the side continuous to the extreme end on the downstream side continuous to the injection hole is formed, and the opening is widened more than the size of the injection hole.

A nozzle body for a fuel injection valve in which opening and closing of a passage for injecting fuel into a cylinder relative to an injection hole relative to the nozzle body from the injection hole provided in the nozzle body is carried out by a valve body characterized in that a fuel turning element provided internally of the injection surface having said injection hole of the nozzle body is connected to the nozzle body by plastic flowing of a fastening member.

A nozzle body for a fuel injection valve in which opening and closing of a passage for injecting fuel into a cylinder relative to an injection hole relative to the nozzle body from the injection hole provided in the nozzle body is carried out by a valve body characterized in that a fuel turning element provided internally of the injection surface having said injection hole of the nozzle body is connected to the nozzle body by plastic flowing of a fastening member, the element is circular in which a square-shaped corner has a diameter corresponding to the inner peripheral surface of the nozzle body, and the square-shaped side is in the form of a recessed portion.

A nozzle body for a fuel injection valve in which opening and closing of a passage for injecting fuel into a cylinder relative to an injection hole relative to the nozzle body from the injection hole provided in the nozzle body is carried out by a valve body is characterized in that the injection surface side member is connected to the nozzle body by plastic flowing or welding.

A method for manufacturing a nozzle body for a fuel injection valve in which opening and closing of a passage for injecting fuel into a cylinder relative to the nozzle body provided in the nozzle body is carried out by a valve body is characterized in that a protrusion having an opening opened in a semi-circular shape with part of the side continuous to the extreme end on the downstream side continuous to the injection hole is formed by plastic processing.

According to the present invention, there is provided a fuel injection valve and its apparatus, and an internal combustion engine, a method for manufacturing the fuel injection valve and its nozzle body, and a method for manufacturing the same capable of securing highly accurate and stabilized fuel spraying characteristics. According to the present invention, there can be obtained the effect that the nozzle accuracy of the fuel injection valve is high, and the productivity is excellent.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A fuel injection valve comprising:

a nozzle body provided with an injection hole therein;

a valve body for opening and closing a fuel passage from said injection hole relative to said nozzle body;

a drive means for driving said valve body; and a protrusion having a semicircular-shaped opening continuous to said injection hole of said nozzle body, part of a side opened continuous to an extreme end on the downstream side thereof, binding walls formed on both sides continuous from said opening to a diametrical direction, and a turning binding wall forming said opening, an outer surface of said protrusion having a round shape, wherein an outer peripheral cross-sectional shape of said protrusion taken along a central axis line of said nozzle body is construed as an arc-shaped curved toward the central axis near a top end thereof, and wherein the extreme end of said protrusion is flat.

2. A fuel injection valve comprising:

a nozzle body provided with an injection hole therein;

a valve body for opening and closing a fuel passage from said injection hole relative to said nozzle body; and a drive means for driving said valve body;

wherein a fuel turning element provided on the injection surface side having said injection hole of said nozzle body is connected to said nozzle body by plastic flowing of a fastening member, wherein a protrusion having a shape round from the extreme end to the side having an opening continuous to said injection hole on the injection surface side having said injection hole of said nozzle body and having part of the side opened continuous to the extreme end on the downstream side thereof is formed in communication with said injection hole, wherein an outer peripheral cross-sectional shape of said protrusion taken along a central axis line of said nozzle body is construed as an arc-shaped curved toward the central axis near a top end thereof, and wherein the extreme end of said protrusion is flat.

3. A fuel injection valve comprising:

a nozzle body provided with an injection hole therein;

a valve body for opening and closing a fuel passage from said injection hole relative to said nozzle body;

a drive means for driving said valve body; and a protrusion having an opening continuous to said injection hole of said nozzle body and having part of a side opened continuously to an extreme end on the downstream side thereof, and a shape round from the extreme end of said opening to the side, wherein an outer peripheral cross-sectional shape of said protrusion taken along a central axis line of said nozzle body is construed as an arc-shape curved toward the central axis near a top end thereof, and wherein the extreme end of said protrusion is flat.

4. The fuel injection valve according to claim 3, wherein the back is formed into a recessed portion corresponding to said protrusion.

5. A fuel injection apparatus comprising:

a fuel injection valve for injection fuel into a cylinder directly;

a pump for supplying fuel under pressure to said fuel injection valve; and a control unit for controlling injection of fuel caused by said fuel injection valve;

wherein said fuel injection valve is the fuel injection valve according to claim 3.

6. An internal combustion engine comprising:

a cylinder;

a piston reciprocating within said cylinder;

an intake means for introducing air into said cylinder;

an exhaust means for exhausting a combustion gas from said cylinder;

a fuel injection apparatus provided with a fuel injection valve;

a fuel supply means for supplying fuel to said fuel injection valve;

an ignition device for ignition a mixture of air introduced into said cylinder by said intake means and fuel injected into said cylinder by said fuel injection valve;

wherein said fuel injection apparatus is the fuel injection apparatus according to claim 3.

* * * * *

UNITED STATES PATENT AND TRADEMARK OFFICE

CERTIFICATE OF CORRECTION

PATENT NO. : 7,124,735 B2
APPLICATION NO. : 11/016749
DATED : October 24, 2006
INVENTOR(S) : Masayuki Kobayashi et al.

It is certified that error appears in the above-identified patent and that said Letters Patent is hereby corrected as shown below:

On the title page, column 1 should read:

Item (63) Continuation of application No. 10/329,439, filed on Dec. 27, 2002, now Pat. No. 6,845,748.

Signed and Sealed this

Sixth Day of March, 2007

JON W. DUDAS
*Director of the United States Patent and Trademark Office*